US005390417A

United States Patent [19]

Brown

[11] Patent Number: 5,390,417

[45] Date of Patent: Feb. 21, 1995

[54] SPAGHETTI FORK AND SEPARATOR SYSTEM

[76] Inventor: Richard H. Brown, 1065 Lomita Blvd. #161, Harbor City, Calif. 90710

[21] Appl. No.: 181,002

[22] Filed: Jan. 14, 1994

[51] Int. Cl.[6] ..... A47J 43/28

[52] U.S. Cl. ..... 30/148; 30/316; 30/322

[58] Field of Search ..... 30/148, 322, 323, 129, 30/130, 137, 316

[56] References Cited

U.S. PATENT DOCUMENTS

| | | | |
|---|---|---|---|
| 1,585,533 | 5/1926 | Coursen et al. | 30/148 |
| 3,611,849 | 10/1971 | Domonkos | 30/316 X |
| 5,088,201 | 2/1992 | Van Manen | 30/148 X |

FOREIGN PATENT DOCUMENTS

| | | | |
|---|---|---|---|
| 402197 | 9/1924 | Germany | 30/316 |
| 567031 | 12/1932 | Germany | 30/129 |
| 2749685 | 5/1979 | Germany | 30/148 |
| 109739 | 2/1917 | United Kingdom | 30/148 |
| 116611 | 2/1918 | United Kingdom | 30/148 |

*Primary Examiner*—Eugenia Jones

[57] ABSTRACT

A spaghetti fork and separator system comprising a fork having a plurality of essentially parallel prongs at the lower end and an elongated handle at the upper end; a plunger having a post in a linear configuration extending generally parallel to the handle of the fork and having a lower end and an upper end, the upper end being bent from the post and constituting a reciprocation member for being grasped by the user for moving the post and plunger in a linear manner parallel with the handle; a separator having struts extending upwardly from the upper end to the lower end of the post; and a guide adapted to encompass the post for guiding the motion of the fork and plunger with respect to each other when the post and separator are pulled by the reciprocation member to allow the prongs of the fork to be exposed for twirling spaghetti and when the post and separator are pushed by the reciprocation member to allow the separator to separate the spaghetti strands from the spaghetti twirled on the prongs of the fork.

1 Claim, 3 Drawing Sheets

SPAGHETTI FORK AND SEPARATOR SYSTEM

BACKGROUND OF THE INVENTION

1. Field of the Invention

The present invention relates to a new and improved spaghetti fork and separator system and more particularly pertains to twirling spaghetti on a plate and separating the twirled spaghetti to a bite-sized configuration without extraneous strands.

2. Description of the Prior Art

The use of forks and other associated eating implements is known in the prior art. More specifically, forks and other associated eating implements heretofore devised and utilized for the purpose of assisting people in eating their food are known to consist basically of familiar, expected, and obvious structural configurations, notwithstanding the myriad of designs encompassed by the crowded prior art which has been developed for the fulfillment of countless objectives and requirements.

A large number of forks and other eating implements are disclosed in the prior art. By way of example, note U.S. Pat. Nos. 3,589,009; 3,552,017; 3,481,037 and 5,005,297.

In this respect, a new and improved spaghetti fork and separator system according to the present invention substantially departs from the conventional concepts and designs of the prior art, and in doing so provides an apparatus primarily developed for the purpose of twirling spaghetti on a plate and separating the twirled spaghetti to a bite-sized configuration without extraneous strands.

Therefore, it can be appreciated that there exists a continuing need for a new and improved spaghetti fork and separator system which can be used for twirling spaghetti on a plate and separating the twirled spaghetti to a bite-sized configuration without extraneous strands. In this regard, the present invention substantially fulfills this need.

SUMMARY OF THE INVENTION

In view of the foregoing disadvantages inherent in the known types of forks and other associated eating implements now present in the prior art, the present invention provides a new and improved spaghetti fork and separator system. As such, the general purpose of the present invention, which will be described subsequently in greater detail, is to provide a new and improved spaghetti fork and separator system and methods which have all the advantages of the prior art and none of the disadvantages.

To attain this, the present invention essentially comprises a new and improved spaghetti fork and separator system comprising, in combination, a fork having a plurality of essentially parallel prongs at the lower end and an elongated handle at the upper end; a plunger having a post in a linear configuration extending generally parallel to the handle of the fork and having a lower end and an upper end, the upper end being bent at about 90 degrees from the post and constituting a reciprocation member for being grasped by the user for moving the post and plunger in a linear manner parallel with the handle; a separator formed with an oval cross-section, the widest part of the oval in a line substantially equal to a line contacting the tips of the prongs of the fork and with its short axis perpendicular thereto, the separator having been formed in a conical configuration being smaller at its lower end and larger at its upper end, the separator also having struts extending upwardly from the upper end to the lower end of the post; and guide means formed as a U-shaped member from a central extent of the fork, the guide means including an aperture adjacent to the handle and adapted to encompass the post for guiding the motion of the fork and plunger with respect to each other when the post and separator are pulled by the reciprocation member to allow the prongs of the fork to be exposed for twirling spaghetti and when the post and separator are pushed by the reciprocation member to allow the separator to separate the spaghetti strands from the spaghetti twirled on the prongs of the fork.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved spaghetti fork and separator system which has all the advantages of the prior art forks and other associated eating implements and none of the disadvantages.

It is another object of the present invention to provide a new and improved spaghetti fork and separator system which may be easily and efficiently manufactured and marketed.

It is a further object of the present invention to provide a new and improved spaghetti fork and separator system which is of a durable and reliable construction.

An even further object of the present invention is to provide a new and improved spaghetti fork and separator system which is susceptible of a low cost of manufacture with regard to both materials and labor, and which accordingly is then susceptible of low prices of sale to the consuming public, thereby making such a new and improved spaghetti fork and separator system economically available to the buying public.

Still yet another object of the present invention is to provide a new and improved spaghetti fork and separator system which provides in the apparatuses and methods of the prior art some of the advantages thereof, while simultaneously overcoming some of the disadvantages normally associated therewith.

Even still another object of the present invention is to twirl spaghetti on a plate and separate the twirled spaghetti to a bite-sized configuration without extraneous strands.

Lastly, it is an object of the present invention to provide a spaghetti fork and separator system comprising a fork having a plurality of essentially parallel prongs at the lower end and an elongated handle at the upper end; a plunger having a post in a linear configuration extending generally parallel to the handle of the fork and having a lower end and an upper end, the upper end being bent from the post and constituting a reciprocation member for being grasped by the user for moving the post and plunger in a linear manner parallel with the handle; a separator having struts extending upwardly from the upper end to the lower end of the post; and guide means adapted to encompass the post for guiding the motion of the fork and plunger with respect to each other when the post and separator are pulled by the reciprocation member to allow the prongs of the fork to be exposed for twirling spaghetti and when the post and separator are pushed by the reciprocation member to allow the separator to separate the spaghetti strands from the spaghetti twirled on the prongs of the fork.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
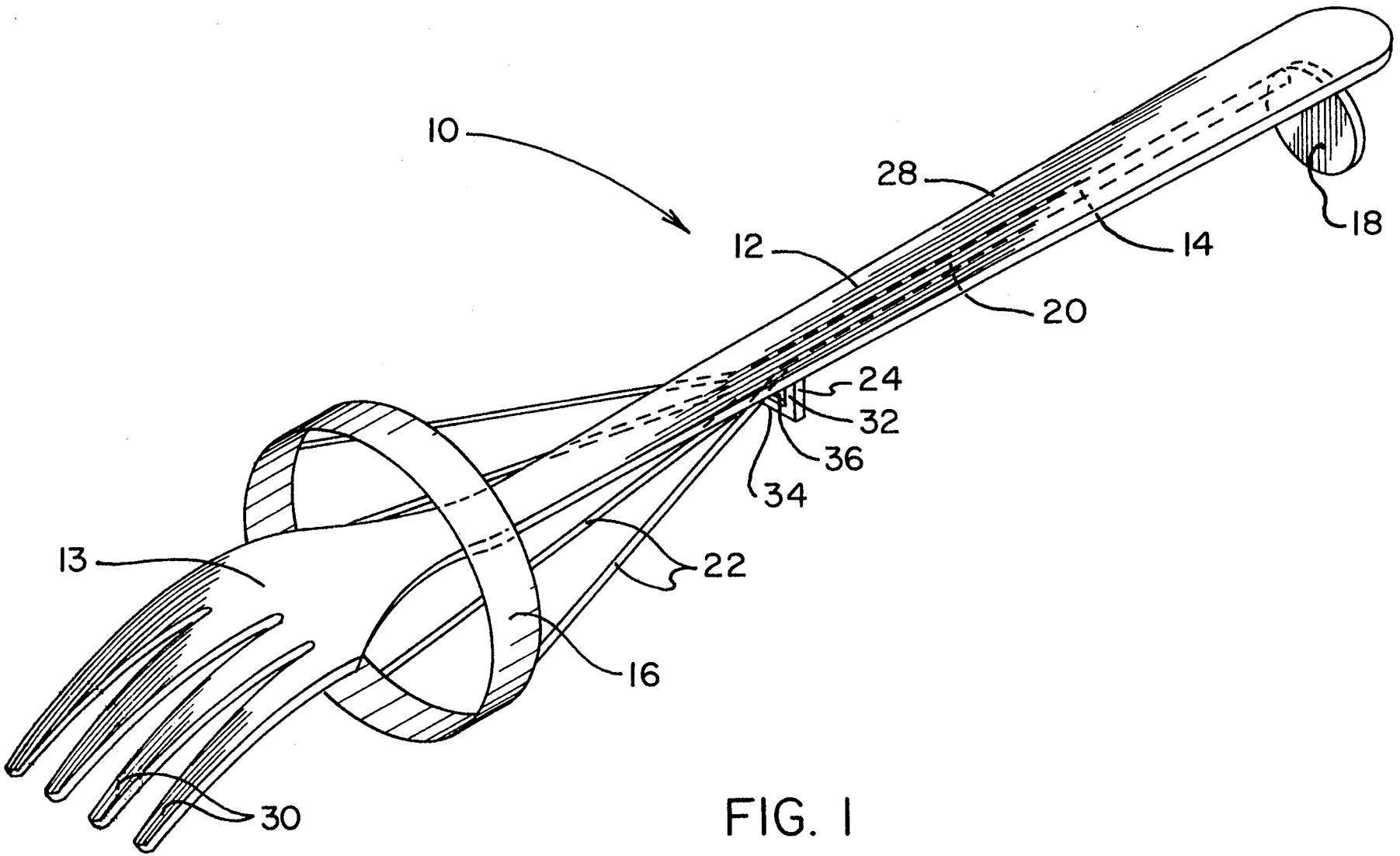
FIG. 1 is a perspective illustration of the preferred embodiment of a new and improved spaghetti fork and separating system constructed in accordance with the principles of the present invention.
Figure 2:
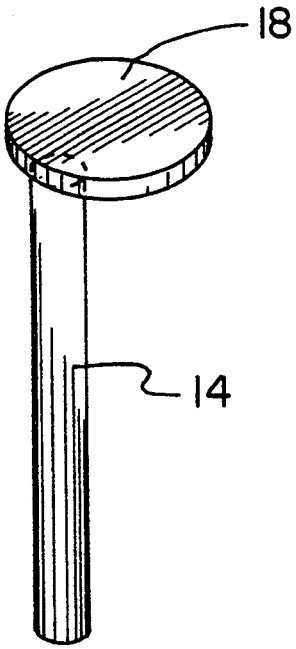
FIG. 2 is a perspective illustration of the end of the plunger remote from the prongs of the fork.
Figure 3:
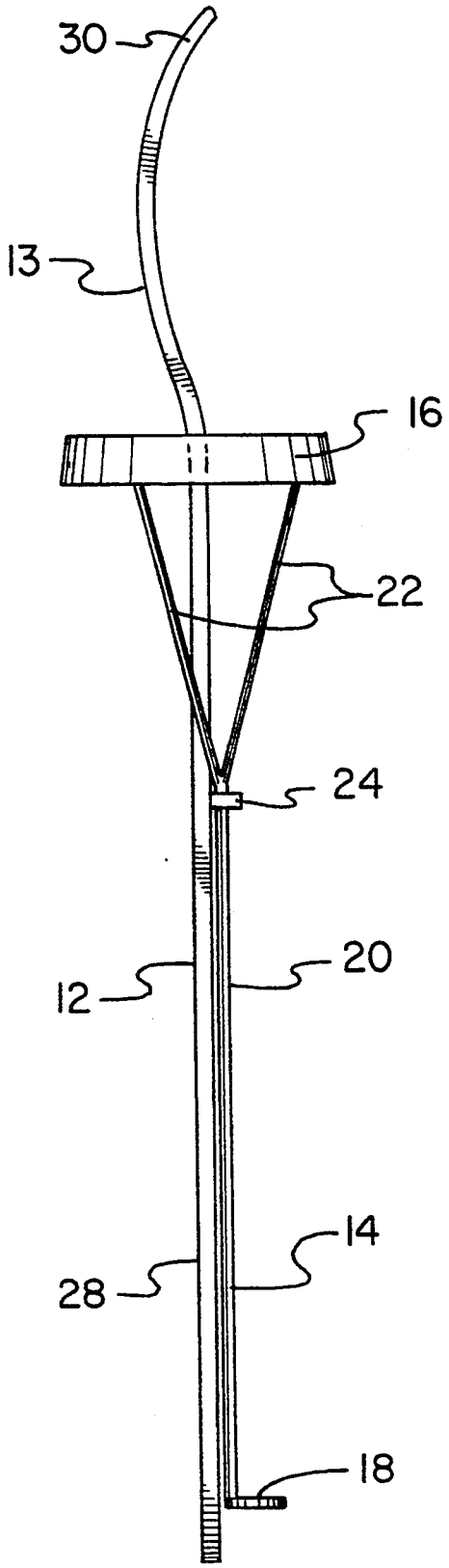
FIG. 3 is a side elevational view of the device as shown in FIG. 1 illustrating the plunger retracted and the fork extended for twirling spaghetti.
Figure 4:
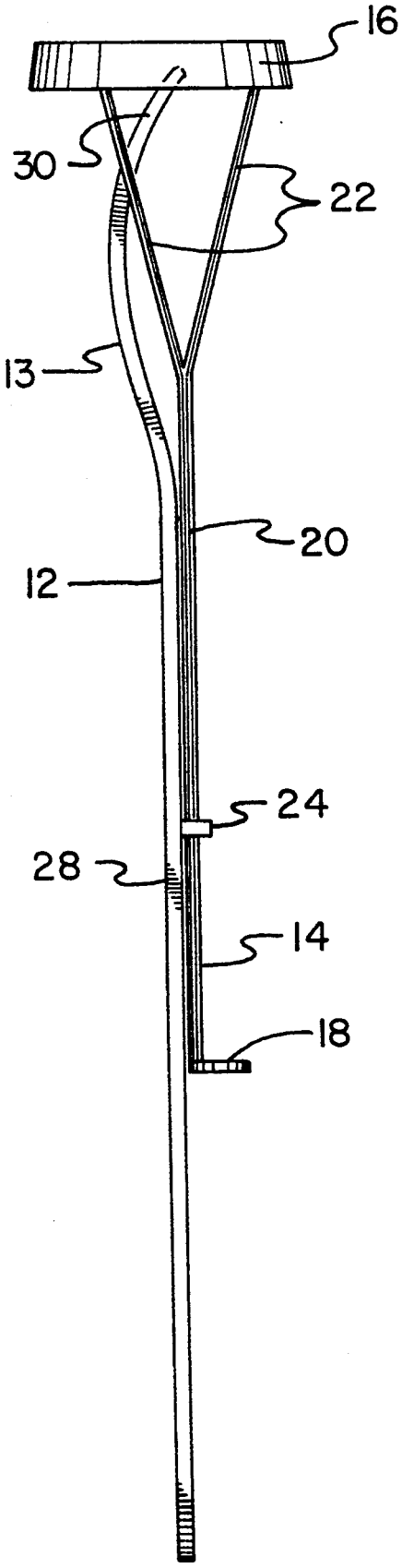
FIG. 4 is a side elevational view similar to FIG. 3 but illustrating the plunger extending forwardly for positioning the separator adjacent to the prongs of the fork for use in separating the ends of the twirled spaghetti on the fork.
Figure 5:
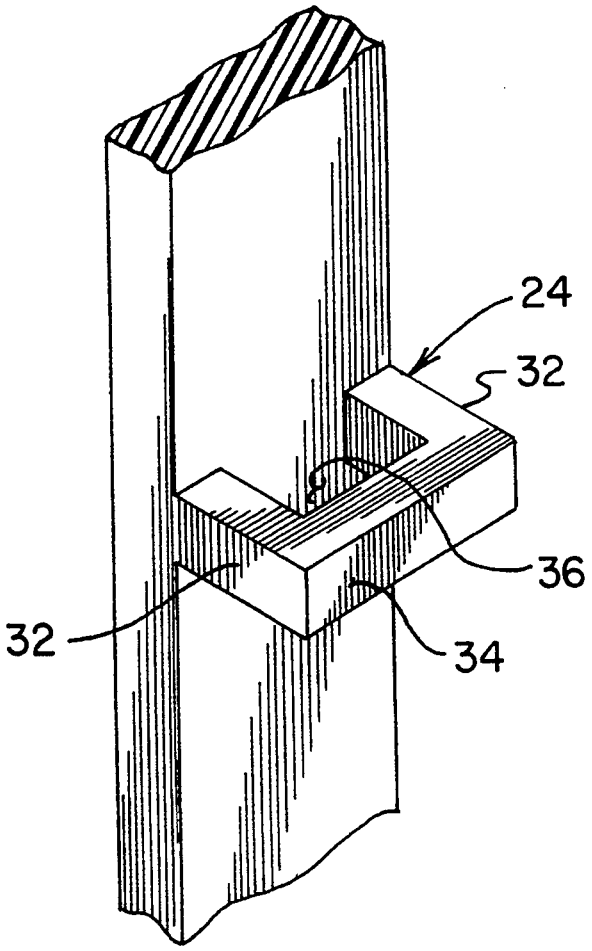
FIG. 5 is a perspective illustration of the coupling between the plunger and the fork.

With reference now to the drawings, and in particular to FIGS. 1 through 5 thereof, the preferred embodiment of the new and improved spaghetti fork and separator system embodying the principles and concepts of the present invention and generally designated by the reference numeral 10 will be described.

Specifically, the present invention may be considered as being a system 10 fabricated of three major components. The first component is a fork 12 of a generally conventional configuration. The second component is the plunger 14 having a separator 16 at its lower end and a reciprocating member 18 at its upper end. A post 20 is located therebetween. Struts 22 couple the upper edge of the separator 16 with the lower end of the post 20. The third component of the system is a coupling component 24 to slidably secure the fork 12 and the plunger 14 for linear reciprocation therebetween. The various components are individually configured and arranged with respect to each other to effect the desired objectives.

More specifically, the fork 12 of the system 10 of the present invention is formed to have a linear handle 28 at the upper extent of the fork. At the lower end of the handle 28 are the prongs 30. The handle and prongs are fabricated as a unitary item as is conventional in the culinary arts. As is also conventional in the culinary arts the handle is generally linear of a size for being grasped and easily manipulated by a user.

In addition, the prongs of the fork are formed with a curved cross-section. Note FIG. 1. This is to facilitate its use in grasping, manipulating and holding food from the plate as it is being lifted to the mouth of the user. The fork is intended to be utilized in the conventional manner for eating food including spaghetti, linguini, angel hair or any of the other conventional forms of pasta which are formed as long strands.

The next major component of the system of the present invention may be considered to be a plunger 14. The plunger 14 has at its central extent a post 20. The post 20 is of a generally linear configuration. It is adapted to be located parallel with, but slightly spaced from, the handle 28 of the fork 12. The post, at its lower end, is adapted to support a separator 16. Struts 22 couple the upper edge of the separator with the lower edge of the post 20.

The separator is formed in a generally cone-shaped configuration with its smaller edge beneath the upper edge which is of a larger size. The separator is in an oval configuration. It has a long axis which is essentially parallel with the tips of the prongs of the fork. The oval also has a short axis. The short axis is perpendicular to the main axis.

This configuration of the separator allows the free ends of spaghetti twirled on the prongs of the fork to be separated or cut from the twirled spaghetti on the fork by movement of the separator from an elevated orientation wherein the prongs are exposed to a lower orientation wherein the separator passes along the lengths of the prongs to separate the spaghetti ends. The separating of the spaghetti ends is such that it will leave on the prongs of the fork only those elements of the twirled spaghetti which are in an oval configuration which generally conforms to the shape of the user's mouth.

At the upper extent of the plunger 14, the upper extent of the post 20, is the reciprocating member 18. The reciprocating member 18 is a circular member the size of a small coin, as for example a penny, ¾ inch in diameter. It is adapted to be grasped by the user. When grasped it may be lifted upwardly to bring the separator above the prongs of the fork to allow the fork to twirl spaghetti. After the spaghetti has been twirled, the reciprocating member 18 may be pushed to push the post downwardly as well as the struts and the separator. This action effects the appropriate separating of the end strands from the twirled spaghetti to create proper sized portions which may be eaten cleanly.

The last component of the system is the coupling component 24. The coupling component 24 is a generally U-shaped member formed integrally with the fork. It includes parallel legs 32 and a cross leg 34. Such legs together with the area of the fork to which it is coupled will form an opening 36. The opening is of such size to receive the plunger and to allow relative linear motion therebetween during the eating of spaghetti with the system of the present invention.

The present invention is a modified dinner fork which allows the user to eat pasta, noodles, and spaghetti without the "slurp and the slop" of standard forks.

The present invention has an oval-shaped separator attached by several spokes to a long post which runs the entire length of the fork handle. This post runs through a guide on the fork handle. The oval separator has no sharp edges, and is completely safe to use. The present invention has a salad fork head mounted on a conventionally sized fork handle. Why a salad fork for eating spaghetti? This innovation is for greater holding power.

To use the present invention, the user would simply twirl the pasta onto the fork using the traditional method. During this process, the separator would be in the "up" position. To implement the present invention's unique cutting action, the user would simply slide the post and separator down and over the tines. This will neatly remove the long "ends" which commonly hang down from the fork when one is eating pasta.

The present invention would be made of stainless steel or plastic. The plastic version would be available in a variety of designer colors to match any dinnerware or kitchen decor.

The present invention has been designed to eliminate the messiness of enjoying pasta, noodles, chow mein, and spaghetti by removing the "ends" which often hang down during eating. Other benefits to consumers include: Available in plastic or stainless steel; Saves clothing and tablecloths from messy stains which may ruin them; Makes eating pasta much less unsightly and embarrassing, especially when in public; Also eliminates the impolite "slurping" which occurs when pasta ends are eaten; A wonderful item for patrons of Italian restaurants; Plastic version available in a variety of colors to match any kitchen or dinnerware; Reasonable cost; The perfect gift for any gourmet cook or pasta lover.

Eating pasta is a delicious but often messy proposition. Long strands can hang down from the eater's fork, splattering sauce onto chin, shirt and tablecloth. And what, diners often wonder, can be done with these strands? Biting and slurping is sloppy and noisy, and no solution is mess-free, simple and polite except the present invention. With its completely safe "separator" unit, it removes stray pasta strands, making pasta eating a pleasure again, even in public. The present invention is the perfect companion for any pasta meal.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A spaghetti fork and separator system comprising, in combination:

a fork having a lower end and an upper end with a plurality of essentially parallel prongs at the lower end terminating in tips and an elongated handle at the upper end;

a plunger having a post extending generally parallel to the handle of the fork and having a lower end and an upper end, the upper end being bent at about 90 degrees from the post and constituting a reciprocation member for being grasped by a user for moving the post and plunger in a linear manner parallel with the handle;

a separator formed with an oval cross-section with a long axis and a short axis, the long axis of the oval being in a line substantially parallel to a line contacting the tips of the prongs of the fork and with the short axis perpendicular thereto, the separator being formed with an upper end and a lower end in a conical configuration with a smaller circumference at its lower end and larger circumference at its upper end, the separator also having struts extending upwardly from the upper end of the separator to the lower end of the post; and guide means formed as a U-shaped member from a central extent of the fork, the guide means including an aperture adjacent to the handle and encompassing the post for guiding the motion of the fork and plunger with respect to each other when the post and separator are pulled by the reciprocation member to allow the prongs of the fork to be exposed for twirling spaghetti and when the post and separator are pushed by the reciprocation member to allow the separator to separate the spaghetti strands from the spaghetti twirled on the prongs of the fork.

* * * * *